US011519157B2

(12) United States Patent
Uemura et al.

(10) Patent No.: US 11,519,157 B2
(45) Date of Patent: Dec. 6, 2022

(54) WORK MACHINE

(71) Applicant: KOMATSU LTD., Tokyo (JP)

(72) Inventors: Takuya Uemura, Tokyo (JP); Yusuke Yamazaki, Tokyo (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 17/233,698

(22) Filed: Apr. 19, 2021

(65) Prior Publication Data

US 2022/0064906 A1 Mar. 3, 2022

(30) Foreign Application Priority Data

Sep. 1, 2020 (JP) ..... JP2020-146962

(51) Int. Cl.
*E02F 9/22* (2006.01)

(52) U.S. Cl.
CPC ..... *E02F 9/2278* (2013.01)

(58) Field of Classification Search
CPC ..... E02F 3/7618
See application file for complete search history.

(56) References Cited

U.S. PATENT DOCUMENTS 5,620,053 A * 4/1997 Kamikawa ..... E02F 3/7618 172/2
9,617,710 B2 * 4/2017 Shimada ..... E02F 5/32

FOREIGN PATENT DOCUMENTS

JP H07-252859 A 10/1995
JP 2005-188276 A 7/2005

* cited by examiner

*Primary Examiner* — Michael Leslie
*Assistant Examiner* — Matthew Wiblin
(74) *Attorney, Agent, or Firm* — Faegre Drinker Biddle & Reath LLP

(57) ABSTRACT

There is provided a work machine that can avoid an unintended movement of a blade. A crawler dozer includes a controller. The controller controls EPC valves. A left tilt cylinder and a right tilt cylinder are asymmetrically attached to a blade. The EPC valves control direction and flow rate of supply of hydraulic oil to the right tilt cylinder. The EPC valves control direction and flow rate of supply of the hydraulic oil to the left tilt cylinder. The controller controls the EPC valves and the EPC valves to extend or contract the left tilt cylinder and the right tilt cylinder at different rates.

7 Claims, 7 Drawing Sheets

WORK MACHINE

This nonprovisional application is based on Japanese Patent Application No. 2020-146962 filed on Sep. 1, 2020, with the Japan Patent Office, the entire contents of which are hereby incorporated by reference.

BACKGROUND OF THE INVENTION

Field of the Invention

The present disclosure relates to a work machine.

Description of the Background Art

Japanese Patent Laying-Open No. 2005-188276 describes that a pair of left and right hydraulic cylinders are provided between a body of a crawler dozer and a blade attached to a front portion of the body and both the hydraulic cylinders are simultaneously driven to be extended or contracted in the same direction, with the result that the blade performs a pitch dump movement (forward inclination movement) or a pitch back movement (rearward inclination movement).

SUMMARY OF THE INVENTION

In a crawler dozer, in order to bring a blade into a tilt posture in which the blade is inclined to the right or left when the blade is in a full pitch back posture, i.e., a soil transporting posture, the left and right hydraulic cylinders may be attached to the blade at different attachment positions in the upward/downward direction or the left and right hydraulic cylinders may be attached to the blade at different attachment angles. When the attachment postures of the left and right hydraulic cylinders to the blade are different, the blade is desired not to be moved against the operator's intention during a pitch movement of inclining the blade forward/rearward.

In the present disclosure, there is proposed a work machine that can avoid an unintended movement of a blade.

According to the present disclosure, there is proposed a work machine including: a body; a blade supported by the body; a left hydraulic cylinder and a right hydraulic cylinder that incline the blade forward/rearward and leftward/rightward; a left control valve that controls direction and flow rate of supply of hydraulic oil to the left hydraulic cylinder; and a right control valve that controls direction and flow rate of supply of the hydraulic oil to the right hydraulic cylinder. The left hydraulic cylinder and the right hydraulic cylinder are asymmetrically attached to the blade. The work machine further includes a controller. The controller controls the left control valve and the right control valve to extend or contract the left hydraulic cylinder and the right hydraulic cylinder at different rates.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
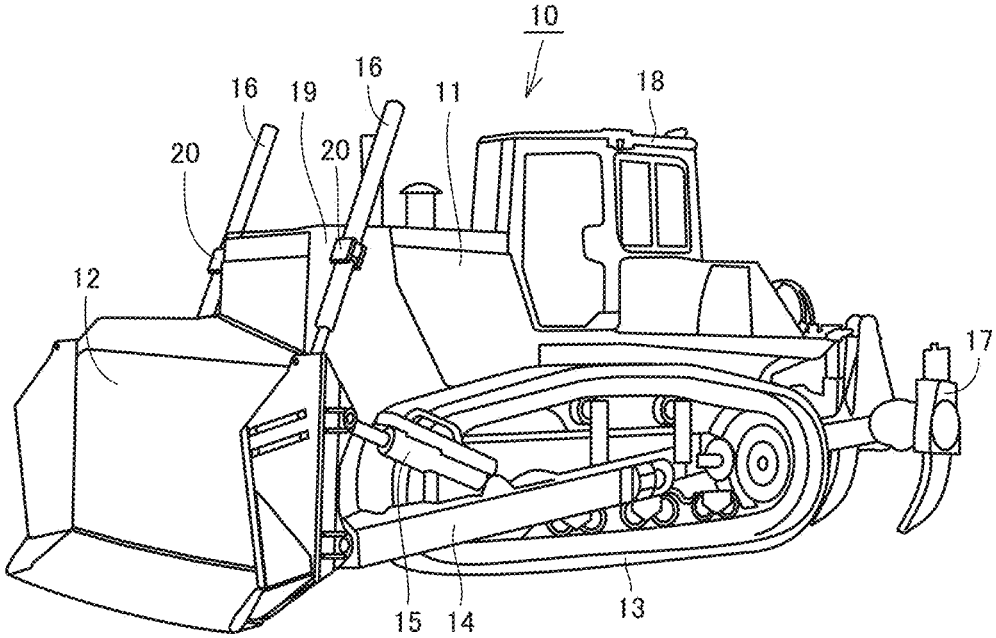
FIG. 1 is a perspective view of a crawler dozer serving as an exemplary work machine according to an embodiment.

Hereinafter, embodiments will be described with reference to figures. In the description below, the same components are denoted by the same reference characters. Their names and functions are also the same. Therefore, they will not be described repeatedly in detail.

First Embodiment (Configuration of Work Machine)

In an embodiment, a crawler dozer 10 will be described as an exemplary work machine. FIG. 1 is a perspective view of crawler dozer 10 serving as an exemplary work machine according to the embodiment.

As shown in FIG. 1, crawler dozer 10 mainly includes: a pair of traveling apparatuses 13 each having a crawler travel unit and separated from each other in the leftward/rightward direction; a body 11 arranged between the pair of left and right traveling apparatuses 13; a blade 12 arranged in front of body 11; and a ripper apparatus 17 arranged behind body 11.

Body 11 includes a cab (operator's cab) 18 and an engine compartment 19. Cab 18 is arranged at a rear upper portion of body 11. An operator who operates crawler dozer 10 rides thereon in cab 18. Cab 18 has an operator's seat therein to allow the operator to sit thereon. Engine compartment 19 is arranged in front of cab 18. Engine compartment 19 is arranged between cab 18 and blade 12. A driving source for crawler dozer 10 such as an internal combustion engine is installed in engine compartment 19.

In the embodiment, a direction in which crawler dozer 10 travels straight is referred to as a forward/rearward direction of crawler dozer 10. In the forward/rearward direction of crawler dozer 10, it is assumed that the forward direction corresponds to a side on which blade 12 protrudes with respect to body 11. In the forward/rearward direction of crawler dozer 10, it is assumed that the rearward direction corresponds to a direction opposite to the forward direction, i.e., a side on which ripper apparatus 17 protrudes with respect to body 11. A leftward/rightward direction of crawler dozer 10 is a direction orthogonal to the forward/rearward direction when viewed in a plan view. The rightward direction corresponds to the right side in the leftward/rightward direction when viewed in the forward direction, and the leftward direction corresponds to the left side in the leftward/rightward direction when viewed in the forward direction. An upward/downward direction of crawler dozer 10 is a direction orthogonal to a plane defined by the forward/rearward direction and the leftward/rightward direction. In the upward/downward direction, the lower side corresponds to the side on which the ground is present, and the upper side corresponds to the side on which the sky is present.

The forward/rearward direction is a forward/rearward direction of the operator sitting on the operator's seat in cab 18. The leftward/rightward direction is a leftward/rightward direction of the operator sitting on the operator's seat. The leftward/rightward direction is a vehicle width direction of crawler dozer 10. The upward/downward direction is an upward/downward direction of the operator sitting on the operator's seat. A direction in which the operator sitting on the operator's seat faces straightly is the forward direction, and a direction backward with respect to the operator sitting on the operator's seat is the rearward direction. The right side and the left side when the operator sitting on the operator's seat faces straightly to the front side correspond to the rightward direction and the leftward direction, respectively. The foot side of the operator sitting on the operator's seat is the lower side, and the head side of the operator sitting on the operator's seat is the upper side.

As a work implement, crawler dozer 10 includes blade 12 in front of body 11. Blade 12 is a work implement for performing a work such as excavation and leveling of a ground surface. As another work implement, crawler dozer 10 includes ripper apparatus 17 behind body 11. Ripper apparatus 17 is a work implement for piercing and crushing a hard material such as rock.

Figure 2:
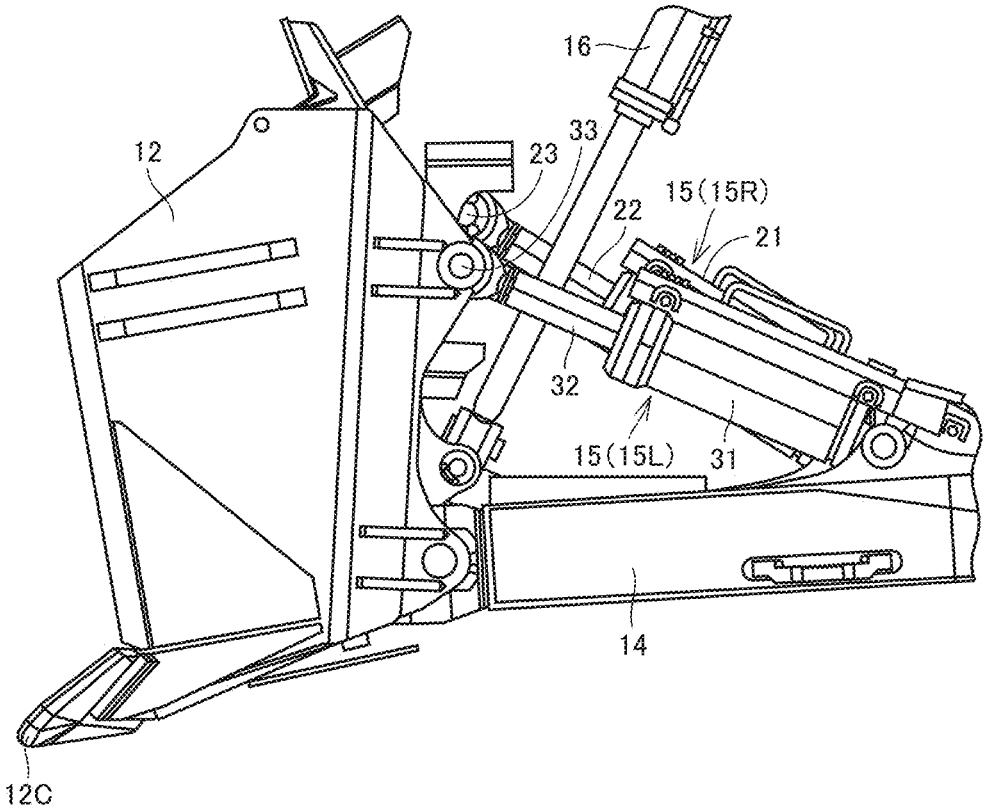
FIG. 2 is an enlarged left side view showing a vicinity of a blade shown in FIG. 1.

FIG. 2 is an enlarged left side view showing a vicinity of blade 12 shown in FIG. 1. Blade 12 is arranged in front of body 11 with a space interposed between blade 12 and body 11. Blade 12 has a blade edge 12C at its lower edge. Blade edge 12C is to be brought into contact with the ground during a work. As shown in FIGS. 1 and 2, blade 12 is supported by frames 14 on both the left and right sides. Blade 12 is supported by body 11 via frames 14.

Each of frames 14 is a member having a quadrangular prism shape. The front end of frame 14 is attached to the rear surface of blade 12 by a rotatable support portion. The rear end of frame 14 is rotatably supported by a side surface of traveling apparatus 13.

Tilt cylinders 15 and lift cylinders 16 are hydraulic cylinders. Blade 12 is driven by tilt cylinders 15 and lift cylinders 16. Although FIG. 1 shows crawler dozer 10 including the pair of lift cylinders 16 on both the left and right sides of body 11, one lift cylinder 16 may be provided.

The front end of each tilt cylinder 15 is rotatably supported by the rear surface of blade 12. The rear end of tilt cylinder 15 is rotatably supported by the upper surface of frame 14. Tilt cylinders 15 include a left tilt cylinder 15L and a right tilt cylinder 15R. Left tilt cylinder 15L is coupled to left frame 14 of body 11 and blade 12. Right tilt cylinder 15R is coupled to right frame 14 of body 11 and blade 12. Left tilt cylinder 15L corresponds to the left hydraulic cylinder of the embodiment. Right tilt cylinder 15R corresponds to the right hydraulic cylinder of the embodiment.

Right tilt cylinder 15R has a cylinder portion 21 and a piston rod 22. Left tilt cylinder 15L has a cylinder portion 31 and a piston rod 32. Cylinder portions 21, 31 are attached to frames 14. Cylinder portions 21, 31 are attached to body 11 via frames 14 and traveling apparatuses 13. The front end of piston rod 22 is attached to the right side of the rear surface of blade 12 via a connection pin 23. The front end of piston rod 32 is attached to the left side of the rear surface of blade 12 via a connection pin 33.

Each of cylinder portions 21, 31 has a hollow cylindrical shape. Piston rods 22, 32 are respectively supported in cylinder portions 21, 31 such that piston rods 22, 32 can reciprocate in the axial directions of cylinder portions 21, 31. Piston rods 22, 32 are configured to change their lengths protruding from the ends of cylinder portions 21, 31 to the outside of cylinder portions 21, 31. Right tilt cylinder 15R and left tilt cylinder 15L are configured to extend and contract their entire lengths in response to reciprocations of piston rods 22, 32.

Right tilt cylinder 15R and left tilt cylinder 15L have the same specification. Right tilt cylinder 15R and left tilt cylinder 15L have the same cylinder length. Right tilt cylinder 15R and left tilt cylinder 15L have the same maximum stroke length.

Connection pin 23 corresponds to the right attachment position of the embodiment at which piston rod 22 of right tilt cylinder 15R is attached to blade 12. Connection pin 33 corresponds to the left attachment position of the embodiment at which piston rod 32 of left tilt cylinder 15L is attached to blade 12. As shown in FIG. 2, the arrangements of connection pin 23 and connection pin 33 are different from each other in the upward/downward direction. Specifically, in the upward/downward direction, connection pin 33 constituting the left attachment position is arranged at a position lower than connection pin 23 constituting the right attachment position.

Figure 3:
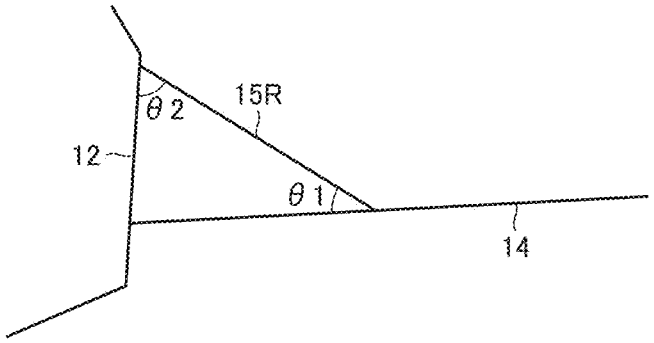
FIG. 3 is a schematic diagram showing angles formed by a right tilt cylinder with respect to a frame and the blade.
Figure 4:
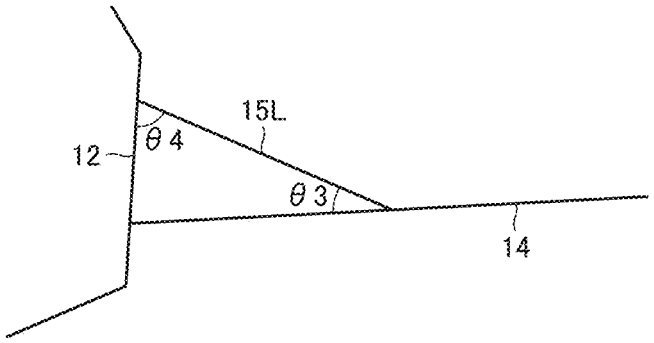
FIG. 4 is a schematic diagram showing angles formed by a left tilt cylinder with respect to the frame and the blade.

FIG. 3 is a schematic diagram showing angles formed by right tilt cylinder 15R with respect to frame 14 and blade 12. FIG. 4 is a schematic diagram showing angles formed by left tilt cylinder 15L with respect to frame 14 and blade 12. As shown in FIG. 2 as well as FIGS. 3 and 4, right tilt cylinder 15R and left tilt cylinder 15L are attached to respective frames 14 or blade 12 at different attachment angles. When blade 12 is not inclined in the leftward/rightward direction with respect to body 11, the angle formed by left tilt cylinder 15L with respect to frame 14 or blade 12 is different from the angle formed by right tilt cylinder 15R with respect to frame 14 or blade 12.

Specifically, when blade 12 is not inclined in the leftward/rightward direction with respect to body 11, an angle $\theta 1$ formed by right tilt cylinder 15R with respect to right frame 14 is larger than an angle $\theta 3$ formed by left tilt cylinder 15L with respect to left frame 14. When blade 12 is not inclined in the leftward/rightward direction with respect to body 11, an angle $\theta 4$ formed by left tilt cylinder 15L with respect to the rear surface of blade 12 is larger than an angle $\theta 2$ formed by right tilt cylinder 15R with respect to the rear surface of blade 12.

Since the arrangements of connection pins 23, 33 are different from each other in the upward/downward direction and the attachment angles of right tilt cylinder 15R and left tilt cylinder 15L with respect to frames 14 or blade 12 are different from each other, right tilt cylinder 15R and left tilt cylinder 15L are asymmetrically arranged with respect to a plane including the upward/downward direction and the center line of crawler dozer 10 (center line of body 11) in the leftward/rightward direction.

The front end of each of lift cylinders 16 is rotatably attached to the rear surface of blade 12. Yokes 20 (FIG. 1) are rotatably attached to the left and right side surfaces of body 11, and intermediate portions of lift cylinders 16 are rotatably supported by the side surfaces of body 11 via yokes 20. By extending and contracting lift cylinders 16 by hydraulic pressure, blade 12 is rotated about the rear ends of frames 14 to move in upward/downward direction. A yoke angle sensor (not shown in FIG. 1) is attached to body 11 to detect the rotation angle of each yoke 20 with respect to body 11. The yoke angle sensor may be a rotation angle sensor such as a rotary encoder.

Figure 5:
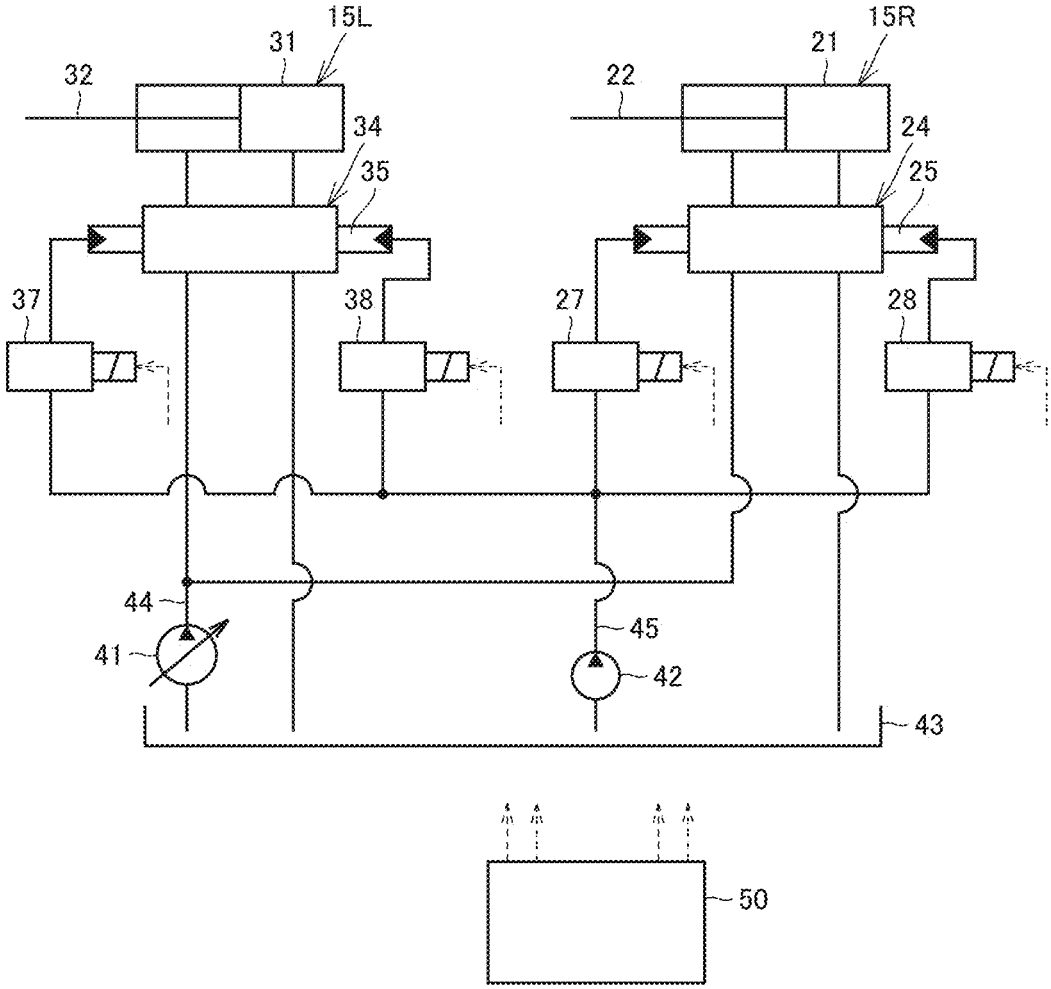
FIG. 5 is a block diagram showing a system configuration of the crawler dozer according to the embodiment.

FIG. 5 is a block diagram showing a system configuration of crawler dozer 10 according to the embodiment. As shown in FIG. 5, in addition to right tilt cylinder 15R and left tilt cylinder 15L, crawler dozer 10 mainly includes: direction control valves 24, 34; EPC valves (electromagnetic proportional control valves) 27, 28, 37, 38; a main hydraulic pump 41; a pilot hydraulic pump 42; and a controller 50.

Main hydraulic pump 41 and pilot hydraulic pump 42 are coupled to an engine in engine compartment 19 (FIG. 1) and are driven by motive power of the engine. Main hydraulic pump 41 supplies oil stored in an oil tank 43 to a hydraulic oil passage 44. Pilot hydraulic pump 42 supplies oil stored in oil tank 43 to a pilot oil passage 45.

Main hydraulic pump 41 supplies hydraulic oil used to drive right tilt cylinder 15R, left tilt cylinder 15L, and lift cylinders 16. The hydraulic oil discharged from main hydraulic pump 41 flows into direction control valves 24, 34 via hydraulic oil passage 44, and is supplied to right tilt cylinder 15R and left tilt cylinder 15L by operations of direction control valves 24, 34. A pressure reducing valve may be provided in hydraulic oil passage 44 between main hydraulic pump 41 and each of direction control valves 24, 34 so as to reduce the pressure of the hydraulic oil to a certain pressure. Return oil from right tilt cylinder 15R, left tilt cylinder 15L, and lift cylinders 16 returns to oil tank 43 via a return pipe passage.

Each of direction control valves 24, 34 is a spool-type valve that has a rod-shaped spool and that moves the spool to switch a direction in which the hydraulic oil flows. When the spool of direction control valve 24 is moved in the axial direction, the direction and flow rate of supply of the hydraulic oil to right tilt cylinder 15R are adjusted. When the spool of direction control valve 34 is moved in the axial direction, the direction and flow rate of supply of the hydraulic oil to left tilt cylinder 15L are adjusted.

In the present example, the oil to be supplied to each of right tilt cylinder 15R and left tilt cylinder 15L in order to operate right tilt cylinder 15R and left tilt cylinder 15L each serving as a hydraulic actuator is referred to as hydraulic oil. The oil to be supplied to each of direction control valves 24, 34 in order to operate the spools of direction control valves 24, 34 is referred to as pilot oil. The pressure of the pilot oil is also referred to as pilot hydraulic pressure.

In FIG. 5, main hydraulic pump 41 for sending out the hydraulic oil and pilot hydraulic pump 42 for sending out the pilot oil are separately provided. The hydraulic oil and the pilot oil may be sent out from the same hydraulic pump. For example, part of the hydraulic oil sent out from main hydraulic pump 41 may be reduced in pressure by a pressure reducing valve, and the oil with the reduced pressure may be used as the pilot oil.

EPC valves 27, 28, 37, 38 are provided in pilot oil passage 45. Each of EPC valves 27, 28, 37, 38 is controlled based on a control signal (EPC current) from controller 50. Each of EPC valves 27, 28, 37, 38 receives EPC current, which is a command value from controller 50, and adjusts the pilot hydraulic pressure based on the current value.

EPC valves 27, 28 adjust the pilot oil pressure of the pilot oil supplied to a pair of pressure receiving chambers 25 of direction control valve 24, thereby moving the spool in the axial direction to adjust a degree of opening of direction control valve 24. Thus, EPC valves 27, 28 can adjust the hydraulic oil supplied to right tilt cylinder 15R via direction control valve 24. Each of EPC valves 27, 28 corresponds to the right control valve of the embodiment that controls the direction and flow rate of supply of the hydraulic oil to right tilt cylinder 15R.

EPC valves 37, 38 adjust the pilot oil pressure of the pilot oil supplied to a pair of pressure receiving chambers 35 of direction control valve 34, thereby moving the spool in the axial direction to adjust a degree of opening of direction control valve 34. Thus, EPC valves 37, 38 can adjust the hydraulic oil supplied to left tilt cylinder 15L via direction control valve 34. Each of EPC valves 37, 38 corresponds to the left control valve of the embodiment that controls the direction and flow rate of supply of the hydraulic oil to left tilt cylinder 15L.

Controller 50 controls part of configurations at least including EPC valves 27, 28, 37, 38, or controls a whole of crawler dozer 10. Controller 50 has a CPU (Central Processing Unit), a nonvolatile memory, a timer, and the like.

(Cylinder Extension/Contraction Rate During Pitch Movement)

When right tilt cylinder 15R and left tilt cylinder 15L are extended or contracted by hydraulic pressure, blade 12 is inclined in the forward/rearward direction. The movement of inclining blade 12 in the forward/rearward direction is referred to as a pitch movement. When right tilt cylinder 15R and left tilt cylinder 15L are extended, blade 12 performs a pitch dump movement (forward inclination movement). When right tilt cylinder 15R and left tilt cylinder 15L are contracted, blade 12 performs a pitch back movement (rearward inclination movement).

The movement of inclining blade 12 in the leftward/rightward direction with respect to body 11 is referred to as a tilt movement. By extending or contracting only one of right tilt cylinder 15R and left tilt cylinder 15L, blade 12 can perform the tilt movement. By extending only left tilt cylinder 15L with right cylinder 15R being not extended or contracted, blade 12 is inclined to the right (tilted to the right). By contracting only left tilt cylinder 15L with right cylinder 15R being not extended or contracted, blade 12 is inclined to the left (tilted to the left). By extending only right tilt cylinder 15R with left tilt cylinder 15L being not extended or contracted, blade 12 is tilted to the left. By contracting only right tilt cylinder 15R with left tilt cylinder 15L being not extended or contracted, blade 12 is tilted to the right.

In crawler dozer 10 of the first embodiment, the arrangements of connection pin 23 and connection pin 33 are different from each other in the upward/downward direction, and the attachment angles of right tilt cylinder 15R and left tilt cylinder 15L with respect to frames 14 or blade 12 are different from each other. Thus, right tilt cylinder 15R and left tilt cylinder 15L are arranged asymmetrically with respect to the plane including the upward/downward direction and the center line of crawler dozer 10 (center line of body 11) in the leftward/rightward direction.

The present inventors have found that when blade 12 is caused to perform the pitch movement by extending or contracting, at an equal rate through a lever operation, a button operation, or the like, right tilt cylinder 15R and left tilt cylinder 15L arranged asymmetrically, blade 12 is also inclined (tilted) to the left or right, with the result that the left end portion of blade 12 is inclined downward during the pitch movement. The present inventors have conducted studies to avoid such an unintended movement that blade 12 is tilted during the pitch movement, and have conceived to extend or contract left tilt cylinder 15L and right tilt cylinder 15R at different rates by configuring such that the command value of the EPC current for right tilt cylinder 15R and the command value of the EPC current for left tilt cylinder 15L can be individually set and by adjusting, during the pitch movement, the command value of the EPC current for left tilt cylinder 15L with respect to the command value of the EPC current for right tilt cylinder 15R.

Figure 6:
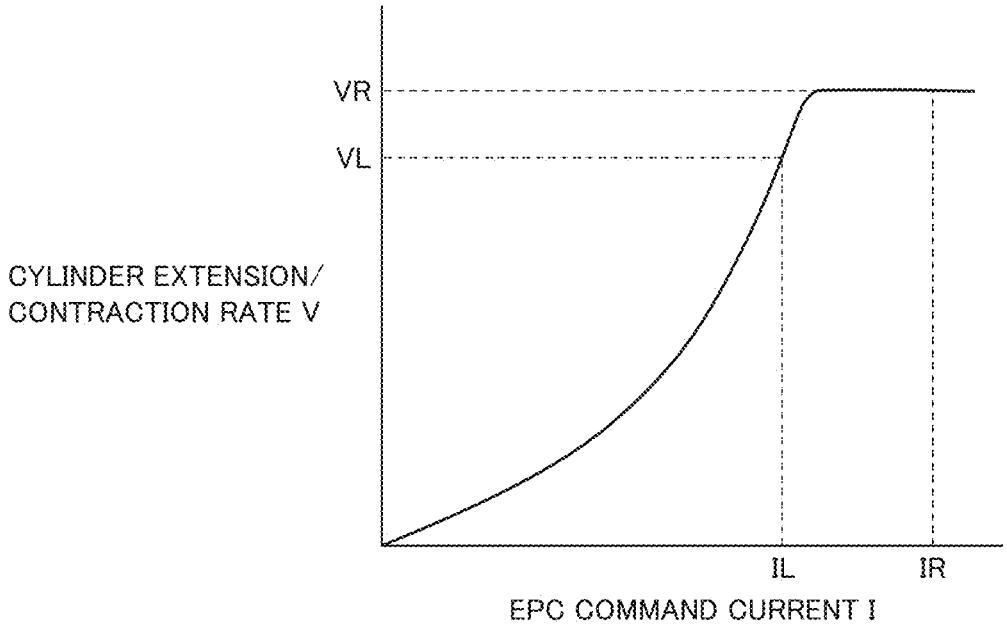
FIG. 6 is a graph showing a relationship between a command value for an EPC valve and a cylinder extension/contraction rate.

FIG. 6 is a graph showing a relationship between a command value for an EPC valve and a cylinder extension/contraction rate. The horizontal axis of the graph shown in FIG. 6 represents a current value output from controller 50 to the EPC valve when blade 12 is caused to perform a pitch movement. A current value IR indicates a current value output to each of EPC valves 27, 28 to control supply of hydraulic oil to right tilt cylinder 15R. A current value IL indicates a current value output to EPC valves 37, 38 to control supply of hydraulic oil to left tilt cylinder 15L.

The vertical axis of FIG. 6 represents an extension/contraction rate of a tilt cylinder 15 when blade 12 is caused to perform a pitch movement. A cylinder extension/contraction rate VR indicates an extension/contraction rate of right tilt cylinder 15R. A cylinder extension/contraction rate VL indicates an extension/contraction rate of left tilt cylinder 15L.

As described with reference to FIG. 2, the left attachment position (connection pin 33) at which left tilt cylinder 15L is attached to blade 12 is located at a lower position in the upward/downward direction with respect to the right attachment position (connection pin 23) at which right tilt cylinder 15R is attached to blade 12. In this case, as shown in FIG. 6, the extension/contraction rate of left tilt cylinder 15L is made smaller than the extension/contraction rate of right tilt cylinder 15R. Cylinder extension/contraction rate VR of right tilt cylinder 15R and cylinder extension/contraction rate VL of left tilt cylinder 15L are expressed as $VL=\alpha\times VR$, where a represents a coefficient of more than 0 and less than 1.

Figure 7A:
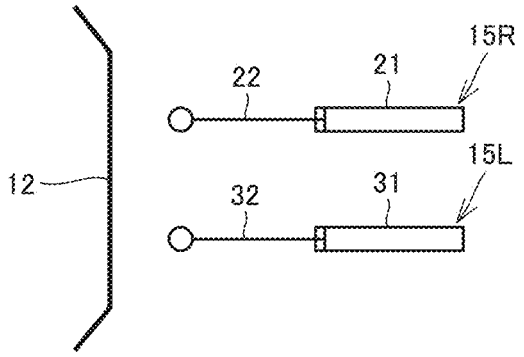
FIGS. 7A and 7B are schematic diagrams showing a pitch movement of the blade and extension and contraction of the cylinders.
Figure 7B:
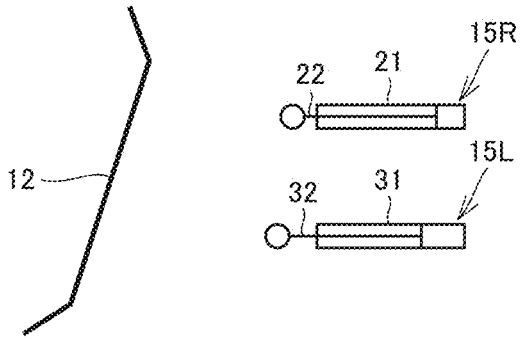

Coefficient $\alpha$ is set in accordance with a ratio of stroke amounts of right tilt cylinder 15R and left tilt cylinder 15L for moving blade 12 from the foremost inclination posture to the rearmost inclination posture. FIGS. 7A and 7B are schematic diagrams showing a pitch movement of blade 12 and extension and contraction of right tilt cylinder 15R and left tilt cylinder 15L. FIGS. 7A and 7B schematically show blade 12 when viewed from the left side, and schematically show extension and contraction states of right tilt cylinder 15R and left tilt cylinder 15L corresponding to the posture of blade 12. FIG. 7A corresponds to a state in which blade 12 is in the foremost inclination posture, and FIG. 7B corresponds to a state in which blade 12 is in the rearmost inclination posture.

As shown in FIG. 7A, when blade 12 is in the foremost inclination posture, the respective cylinder lengths of right tilt cylinder 15R and left tilt cylinder 15L are maximum. Right tilt cylinder 15R and left tilt cylinder 15L shown in FIG. 7A are both in the most extended state, and piston rods 22, 32 are both located at the stroke end positions.

As shown in FIG. 7B, when blade 12 is in the rearmost inclination posture, the cylinder length of right tilt cylinder 15R is minimum. Right tilt cylinder 15R shown in FIG. 7B is in the most contracted state, and piston rod 22 is located at the stroke end position. On the other hand, the cylinder length of left tilt cylinder 15L is not minimum, and piston rod 32 is not located at the stroke end position. The stroke amount of left tilt cylinder 15L for moving blade 12 from the foremost inclination posture to the rearmost inclination posture is smaller than the stroke amount of right tilt cylinder 15R for moving blade 12 from the foremost inclination posture to the rearmost inclination posture.

For example, when the stroke amount of left tilt cylinder 15L for moving blade 12 from the foremost inclination posture to the rearmost inclination posture is smaller by 10% than the stroke amount of right tilt cylinder 15R for moving blade 12 from the foremost inclination posture to the rearmost inclination posture, cylinder extension/contraction rate VL of left tilt cylinder 15L is set to be smaller by 10% than cylinder extension/contraction rate VR of right tilt cylinder 15R and coefficient $\alpha=0.9$ can be attained. Current value IL when cylinder extension/contraction rate VL of left tilt cylinder 15L is 0.9 time as large as cylinder extension/contraction rate VR of right tilt cylinder 15R is obtained using the graph of FIG. 6. By providing each of EPC valves 37, 38 with an appropriate current value IL smaller than current value IR to be provided to each of EPC valves 27, 28, a ratio of the rates of the left and right tilt cylinders 15 is appropriately set.

Figure 8A:
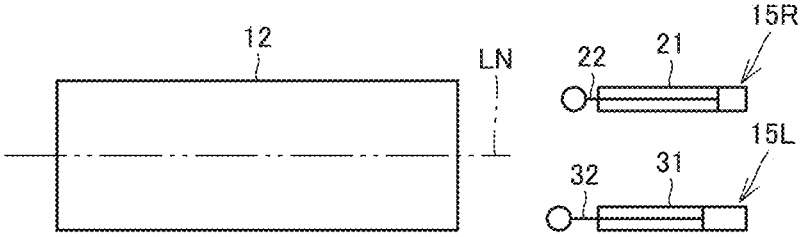
FIGS. 8A and 8B are schematic diagrams showing a tilt movement of the blade and the extension and contraction of the cylinders.
Figure 8B:
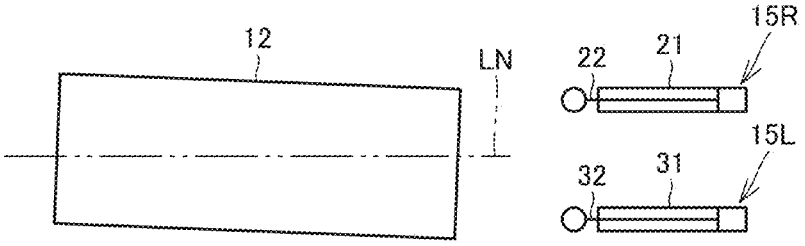

FIGS. 8A and 8B are schematic diagrams showing a tilt movement of blade 12 and extension and contraction of right tilt cylinder 15R and left tilt cylinder 15L. FIGS. 8A and 8B schematically show blade 12 when viewed from the front side, and schematically show extension and contraction states of right tilt cylinder 15R and left tilt cylinder 15L corresponding to the posture of blade 12. A straight line LN indicated by a chain double-dashed line in each of FIGS. 8A and 8B represents a line parallel to the lower surface of the crawler belt of traveling apparatus 13.

Blade 12 shown in FIG. 8A is in the rearmost inclination posture. In the rearmost inclination posture, blade 12 when viewed from the front side is not tilted. By controlling the extension/contraction rates of left tilt cylinder 15L and right tilt cylinder 15R through the above-described setting, blade 12 maintains the non-tilted posture during the pitch movement from the foremost inclination posture to the rearmost inclination posture. Right tilt cylinder 15R and left tilt cylinder 15L shown in FIG. 8A are in the same extension/contraction states as those in FIG. 7B. The cylinder length of right tilt cylinder 15R is minimum. The cylinder length of left tilt cylinder 15L is not minimum, and left tilt cylinder 15L can be further contracted.

As compared with FIG. 8A, in FIG. 8B, right tilt cylinder 15R is not extended or contracted with its cylinder length remaining minimum, and left tilt cylinder 15L is contracted to have the minimum cylinder length. Left tilt cylinder 15L is in the most contracted state, and piston rod 32 is located at the stroke end position. As described above, when only left tilt cylinder 15L is contracted with right tilt cylinder 15R being not extended or contracted, blade 12 is inclined to the left (tilted to the left). When blade 12 is in the rearmost inclination posture (full pitch back posture), the tilt movement of inclining the blade to the left or right can be performed.

(Function and Effect)

Although there are descriptions partially overlapping with the above descriptions, the characteristic configuration, function and effect of the present embodiment will be collectively described as follows.

As shown in FIG. 5, crawler dozer 10 of the embodiment includes controller 50. Controller 50 controls EPC valves 27, 28, 37, 38. As shown in FIG. 2, left tilt cylinder 15L and right tilt cylinder 15R are attached to blade 12 asymmetrically. Each of EPC valves 27, 28 shown in FIG. 5 corresponds to the right control valve of the embodiment that controls the direction and flow rate of supply of the hydraulic oil to right tilt cylinder 15R. Each of EPC valves 37, 38 corresponds to the left control valve of the embodiment that controls the direction and flow rate of supply of the hydraulic oil to left tilt cylinder 15L. As shown in FIGS. 7A and 7B, controller 50 controls EPC valves 27, 28 and EPC valves 37, 38 to extend or contract left tilt cylinder 15L and right tilt cylinder 15R at different rates.

Controller 50 can adjust each of command values for EPC valves 27, 28 and EPC valves 37, 38, and can individually set pilot hydraulic pressures for left and rightward direction control valves 24, 34. Thus, controller 50 can individually set the contraction rates of left tilt cylinder 15L and right tilt cylinder 15R during a pitch movement of inclining blade 12 in the forward/rearward direction.

By contracting right tilt cylinder 15R and left tilt cylinder 15L, which are asymmetrical in the leftward/rightward direction, during the pitch movement at different rates, it is possible to perform control to cause blade 12 to perform the pitch movement from the foremost inclination posture to the rearmost inclination posture without tilting blade 12. Since blade 12 can be avoided from performing a tilt movement against the operator's intention during the pitch movement, an operation of correcting the posture of blade 12 inclined to the left or right can be unnecessary, thereby improving operability.

As shown in FIG. 2, the position of connection pin 33 at which left tilt cylinder 15L is attached to blade 12 and the position of connection pin 23 at which right tilt cylinder 15R is attached to blade 12 are different from each other in the upward/downward direction, and connection pin 33 is arranged to be lower than the position of connection pin 23 in the upward/downward direction. As shown in FIGS. 7A and 7B, the rate of contracting left tilt cylinder 15L is made smaller than the rate of contracting right tilt cylinder 15R. By thus adjusting the cylinder extension/contraction rates of left and right tilt cylinders 15 so as to correspond to the arrangements of right tilt cylinder 15R and left tilt cylinder 15L, the tilt movement of blade 12 can be securely avoided during the pitch movement.

As shown in FIGS. 7A and 7B, the stroke amount of left tilt cylinder 15L for moving blade 12 from the foremost inclination posture to the rearmost inclination posture is smaller than the stroke amount of right tilt cylinder 15R for moving blade 12 from the foremost inclination posture to the rearmost inclination posture. As shown in FIGS. 8A and 8B, since left tilt cylinder 15L can be further contracted when blade 12 is in the rearmost inclination posture, blade 12 can be tilted in the rearmost inclination posture.

As shown in FIG. 2, when blade 12 is not inclined in the leftward/rightward direction with respect to body 11, the angle formed by left tilt cylinder 15L with respect to blade 12 and the angle formed by right tilt cylinder 15R with respect to blade 12 are different from each other. By adjusting the cylinder extension/contraction rates of left and right tilt cylinders 15 so as to correspond to the respective attachment angles with respect to blade 12, the tilt movement of blade 12 can be securely avoided during the pitch movement.

As shown in FIGS. 7A and 7B as well as FIGS. 8A and 8B, left tilt cylinder 15L and right tilt cylinder 15R have the same maximum stroke length. Since hydraulic cylinders having the same specification are used for left and right tilt cylinders 15, the same type of products can be used for the left and right hydraulic cylinders, thereby reducing manufacturing cost of crawler dozer 10.

Controller 50 may be capable of changing the setting value of the extension/contraction rate of at least one of left tilt cylinder 15L and right tilt cylinder 15R. Each of EPC valves 27, 28 and EPC valves 37, 38 shown in FIG. 5 receives EPC current, which is a command value from controller 50, and controls the hydraulic oil to be supplied to right tilt cylinder 15R and left tilt cylinder 15L. Controller 50 may be capable of changing at least one of the command value for each of EPC valves 27, 28 and the command value for each of EPC valves 37, 38.

Even though left and right tilt cylinders 15 have the same specification, left and right tilt cylinders 15 may have individual variations. By enabling adjustment of the setting values of the cylinder extension/contraction rates so as to correspond to the individual difference between tilt cylinders 15, blade 12 can be moved from the foremost inclination posture to the rearmost inclination posture while securely avoiding blade 12 from performing a tilt movement during the pitch movement of blade 12. For example, by fixing the relatively large cylinder extension/contraction rate of right tilt cylinder 15R and adjusting the cylinder extension/contraction rate of left tilt cylinder 15L relative to the cylinder extension/contraction rate of right tilt cylinder 15R, the non-tilted posture of blade 12 can be maintained.

Second Embodiment

Figure 9:
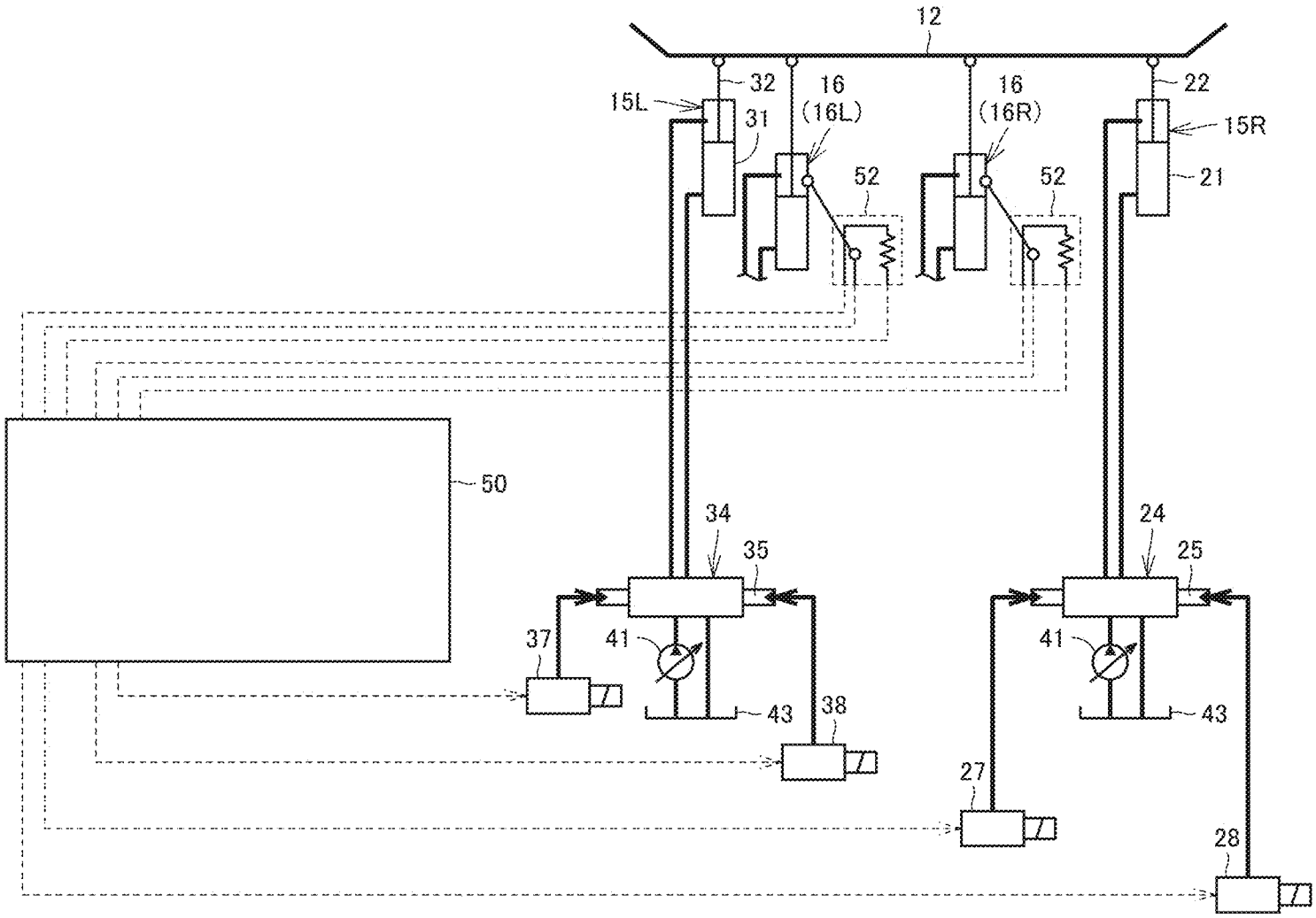
FIG. 9 is a block diagram showing a system configuration of a crawler dozer according to a second embodiment.

FIG. 9 is a block diagram showing a system configuration of a crawler dozer 10 according to a second embodiment. In the second embodiment, the following describes an example of using feedback control that utilizes a sensing function of each of lift cylinders 16.

As shown in FIG. 9, lift cylinders 16 include: left lift cylinder 16L arranged on the left side of body 11; and right lift cylinder 16R arranged on the right side of body 11. As described with reference to FIG. 1, right lift cylinder 16R and left lift cylinder 16L are rotatably supported by the side surfaces of body 11 via yokes 20. Yoke angle sensors 52 are attached to body 11. Yoke angle sensors 52 detect rotation angles (yoke angles) of left and right yokes 20 with respect to body 11. Instead of yoke angle sensors 52, cylinder stroke sensors may be attached to left and right lift cylinders 16 so as to detect extension and contraction amounts of left and right lift cylinders 16.

The left and right yoke angles detected by yoke angle sensors 52 or the extension and contraction amounts of left and right lift cylinders 16 detected by the cylinder stroke sensors are input to controller 50. Based on each of the input detection results, controller 50 adjusts EPC current to be output to each of EPC valves 27, 28, 37, 38, so as to eliminate a difference between the yoke angles or between the extension/contraction amounts of lift cylinders 16 on the left and right sides. Referring also to FIG. 6, current value IR to be output to each of EPC valves 27, 28 for controlling the hydraulic oil for right tilt cylinder 15R may be constant, and current value IL to be output to each of EPC valves 37, 38 for controlling the hydraulic oil for left tilt cylinder 15L may be adjusted.

Based on the detection results about left and right lift cylinders 16, feedback control is performed to change the setting values of the extension/contraction rates of left tilt cylinder 15L and right tilt cylinder 15R by adjusting each of command values to be output to EPC valves 27, 28 and EPC valves 37, 38. Accordingly, the pitch movement can be performed while correcting the posture of blade 12, thereby more securely maintaining the non-tilted posture of blade 12. This eliminates the need for initial adjustment of the posture of blade 12, thereby further improving operability.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A work machine comprising:

a body;

a blade supported by the body;

a left hydraulic cylinder and a right hydraulic cylinder that incline the blade forward/rearward and leftward/rightward;

a left control valve that controls direction and flow rate of supply of hydraulic oil to the left hydraulic cylinder;

a right control valve that controls direction and flow rate of supply of the hydraulic oil to the right hydraulic cylinder;

a left direction control valve through which the hydraulic oil supplied to the left hydraulic cylinder flows; and a right direction control valve through which the hydraulic oil supplied to the right hydraulic cylinder flows, wherein the left hydraulic cylinder and the right hydraulic cylinder are asymmetrically attached to the blade, the left control valve controls the direction and flow rate of the hydraulic oil supplied to the left hydraulic cylinder via the left direction control valve, and the right control valve controls the direction and flow rate of the hydraulic oil supplied to the right hydraulic cylinder via the right direction control valve, the work machine further comprising a controller that controls the left control valve and the right control valve to simultaneously extend or contract the left hydraulic cylinder and the right hydraulic cylinder at different rates from each other when the blade performs a pitch movement of inclining the blade in the forward/rearward direction from a foremost inclination posture to a rearmost inclination posture without tilting the blade, wherein a ratio of an extension/contraction rate of the left hydraulic cylinder to an extension/contraction rate of the right hydraulic cylinder is set in accordance with a ratio of stroke amount of the left hydraulic cylinder and stroke amount of the right hydraulic cylinder while the blade moves from the foremost inclination posture to the rearmost inclination posture.

2. The work machine according to claim 1, wherein a left attachment position at which the left hydraulic cylinder is attached in the blade and a right attachment position at which the right hydraulic cylinder is attached in the blade are different from each other in an upward/downward direction, and during the pitch movement of inclining the blade in the forward/rearward direction from the foremost inclination posture to the rearmost inclination posture without tilting the blade, an extension/contraction rate of one of the left hydraulic cylinder and the right hydraulic cylinder is smaller than an extension/contraction rate of the other of the left hydraulic cylinder and the right hydraulic cylinder, the respective attachment position of the one of the left hydraulic cylinder and the right hydraulic cylinder being relatively low in the upward/downward direction, the respective attachment position of the other of the left hydraulic cylinder and the right hydraulic cylinder being relatively high in the upward/downward direction.

3. The work machine according to claim 2, wherein the left attachment position is a position lower than the right attachment position in the upward/downward direction, and during the pitch movement of inclining the blade in the forward/rearward direction from the foremost inclination posture to the rearmost inclination posture without tilting the blade, the extension/contraction rate of the left hydraulic cylinder is smaller than the extension/contraction rate of the right hydraulic cylinder.

4. The work machine according to claim 2, wherein, during the pitch movement of inclining the blade in the forward/rearward direction from the foremost inclination posture to the rearmost inclination posture without tilting the blade, the stroke amount of the left hydraulic cylinder while the blade moves from the foremost inclination posture to the rearmost inclination posture is smaller than the stroke amount of the right hydraulic cylinder while the blade moves from the foremost inclination posture to the rearmost inclination posture.

5. The work machine according to claim 1, wherein when the blade is not inclined in a leftward/rightward direction with respect to the body, an angle formed by the left hydraulic cylinder with respect to the blade is different from an angle formed by the right hydraulic cylinder with respect to the blade.

6. The work machine according to claim 1, wherein the left hydraulic cylinder and the right hydraulic cylinder have the same maximum stroke length.

7. The work machine according to claim 1, wherein the controller is capable of changing a setting value of an extension/contraction rate of at least one of the left hydraulic cylinder and the right hydraulic cylinder.

* * * * *